US006530539B2

(12) United States Patent
Goldman et al.

(10) Patent No.: US 6,530,539 B2
(45) Date of Patent: Mar. 11, 2003

(54) INTERNAL FLUID COOLED WINDOW ASSEMBLY

(75) Inventors: Lee M. Goldman, Lexington, MA (US); Steven R. Collins, Lexington, MA (US); David B. James, Andover, MA (US); David M. Blanchard, Tucson, AZ (US); Steven Wirth, Oro Valley, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/780,828

(22) Filed: Feb. 9, 2001

(65) Prior Publication Data

US 2002/0109038 A1 Aug. 15, 2002

(51) Int. Cl.[7] ..... F42B 15/34; F41G 7/00

(52) U.S. Cl. ..... 244/3.16; 244/3.15; 359/845; 359/894; 313/17; 313/22

(58) Field of Search ..... 244/3.15, 3.16, 244/3.17, 3.18; 359/350, 845, 894; 378/161; 118/722, 724, 725; 313/17–28, 33–36, 11, 46, 364, 420

(56) References Cited

U.S. PATENT DOCUMENTS 4,409,511 A * 10/1983 Loda et al. ..... 313/34
4,645,966 A * 2/1987 van Esdonk ..... 313/24
5,073,831 A * 12/1991 Flint ..... 359/845
5,075,797 A * 12/1991 Jones ..... 359/350
5,372,333 A * 12/1994 Uwira et al. ..... 244/3.16
5,509,046 A * 4/1996 Logan ..... 378/161
5,898,261 A * 4/1999 Barker ..... 313/35
6,284,051 B1 * 9/2001 Fidelman ..... 118/724

FOREIGN PATENT DOCUMENTS

JP 63098 A * 1/1994 ..... F42B/15/01
JP 06003098 A 1/1994
JP 10141897 A 5/1998
JP 10141897 A * 5/1998 ..... F42B/10/46

* cited by examiner

*Primary Examiner*—Bernarr E. Gregory
(74) *Attorney, Agent, or Firm*—Iandiorio & Teska; R. Stephen Rosenholm; Kirk Teska

(57) ABSTRACT

An interceptor missile including an infrared radiation detection subsystem and a window assembly in the hull of the missile optically coupled to the infrared radiation detection subsystem. The window assembly includes an inner window, an outer window, and a support subsystem between the inner and the outer windows defining a plurality of infrared transparent fluid flow cooling channels between the inner and outer windows. A source of fluid coupled to the cooling channels for cooling the outer window without adversely affecting the optical properties of either window.

22 Claims, 6 Drawing Sheets

INTERNAL FLUID COOLED WINDOW ASSEMBLY

FIELD OF THE INVENTION

This invention relates to window assemblies subjected to extreme heat such as the infrared seeker window in an interceptor missile.

BACKGROUND OF INVENTION

High speed interceptor missiles often incorporate infrared radiation seeker technology to aid in target discrimination. A window assembly formed in the body of the missile is placed in optical communication with the infrared seeker subsystem so that it can receive and analyze infrared radiation emitted by the target. In some designs, when the interceptor missile closes in on a target in flight, a protective cover over the window assembly is blown off the missile, the infrared seeker receives infrared radiation emitted by the target, and, in response, the trajectory of the interceptor missile is adjusted to properly intercept the target.

One important design consideration of the window assembly is the frictional heating caused by the high velocity flow of air over the outer surface of window assembly. If not addressed, this heating can cause destructive thermal shocks, optical distortion, and/or cause the window itself to emit infrared radiation which interferes with the image received by the infrared sensor on board the interceptor missile.

Accordingly, two prior art methods have been developed in an attempt to cool the window assembly from the frictional heating effects of the air stream flowing over it. In one method, helium gas is caused to flow along the outside of the window between the exterior surface of the window and the boundary layer. This method, called "external film cooling" suffers from the disadvantages that a large quantity of cooling gas must be stored on board the interceptor missile, special design considerations must be employed to insure a uniform boundary layer, and the associated valves, feedback mechanisms, and the complexity of such a system results in a costly system prone to failure.

The cooling effectiveness of the stream of gas over the outer surface of the window can be adversely impacted by changes in attitude and interactions between the divert thrusters of the missile and the air stream. In addition, the turbulent interaction between the atmospheric and coolant streams can degrade image quality, which limits the choice of cooling fluids to a lightweight gas, such as helium and precludes the use of other cooling gas design choices. The impact of this is to constrain external film cooled systems to the use a cooling gas which limits the maximum packaging efficiency.

In another prior art approach, called "internal liquid cooling", internal channels are formed within the window to carry a liquid coolant. Since the liquid coolant is opaque to infrared radiation, however, the internal cooling channels must be made relatively narrow and widely spaced in order to transmit sufficient infrared radiation through the window. In other words, only the infrared radiation impinging on the window in the areas of the window which are not cooled by the internal liquid cooling channels can be imaged and thus the active area of the window is limited by the space taken up by the cooling channels. Moreover, significant temperature gradients created between and along the cooling channels produce a laterally non-uniform index of refraction which degrades the infrared radiation image. Also, defraction of signals from targets or the sun by the cooling channels can cause false targets in the field of view of the window.

SUMMARY OF THE INVENTION

It is therefore an object of this invention to provide an internal fluid cooled window assembly.

It is a further object of this invention to provide such a window assembly which can be effectively cooled without using as much gas as an externally cooled window assembly.

It is a further object of this invention to provide such a window assembly which can be effectively cooled without adversely affecting the optical characteristics of the window.

It is a further object of this invention to provide such a window assembly which does not require special design considerations employed to ensure a uniform boundary layer.

It is a further object of this invention to provide such a window assembly which does not require complex valves and feedback mechanisms thus resulting in a less costly design.

It is a further object of this invention to provide such a window assembly which is effectively cooled irrespective of changes in the attitude of the missile and interactions between the divert thrusters of the missile and the air stream flowing over the window.

It is a further object of this invention to provide such a window assembly which can be cooled using a number of different kinds of gases to improve the packaging efficiency.

It is a further object of this invention to provide such a window assembly which utilizes an internal cooling gas transparent to infrared radiation.

It is a further object of this invention to provide such a window assembly which has wide cooling channels separated by narrow spacer elements to reduce or eliminate temperature gradients created between and along the cooling channels.

It is a further object of this invention to provide such a window assembly which does not result in false targets in the field of view of the window assembly.

It is a further object of this invention to provide such a window assembly which is effectively cooled without degrading image quality.

It is a further object of this invention to provide such a window assembly which meets or exceeds the mechanical loading and thermal mechanical shock requirements for advanced interceptor missiles.

It is a further object of this invention to provide such a window assembly which requires less cooling volume and simpler gas flow controls.

It is a further object of this invention to provide such a window assembly which minimizes lateral temperature gradients and the resulting spatially independent phase errors.

It is a further object of this invention to provide a window assembly which can be used in conjunction with any high temperature vessel.

The invention results from the realization that a missile window assembly can be effectively cooled without using as much gas as an externally cooled window and without disrupting the optical characteristics of the window as is the case with internal liquid cooled windows by including wide cooling channels separated by narrow spacer elements between a strong thick inner window and a thin outer window and by utilizing a fluid in the cooling channels such as a gas which is transparent to infrared radiation.

This invention features an internal fluid cooled window assembly comprising an inner window, an outer window, and a support subsystem between the inner window and the outer window defining at least one transparent fluid flow channel between the inner and outer windows for cooling the outer window without adversely affecting the optical properties of either window.

The inner window typically has a thickness substantially greater than the thickness of the outer window and the support subsystem preferably includes a plurality of longitudinally running spacer elements between the inner and outer windows, each pair of adjacent spacer elements defining a cooling channel therebetween. In one embodiment, each spacer element is made of two different materials and preferably the materials of the spacer elements in combination have a thermal conductivity which matches the convective heat transfer rate of the fluid flowing in the channels.

For use in conjunction with interceptor missiles, the fluid is preferably a gas such as nitrogen, helium, argon, or sulfur hexaflouride all of which are transparent to infrared radiation. In other environments, the fluid may be a liquid which includes water.

The inner and outer windows are preferably made of a material such as aluminum oxidynitride, yttria, aluminum oxide, zinc sulfide, silicon, gallium phosphide, or diamond. Two design considerations are that each cooling channel between the inner and outer windows should have a cross sectional area sufficient to prevent sonic flow velocities of the fluid flowing therein and the support subsystem preferably defines a plurality of flow channels the combined area of which is substantially greater than area occupied by the support subsystem.

An interceptor missile in accordance with this invention includes an infrared radiation detection subsystem and a window assembly in the hull of the missile optically coupled to the infrared radiation detection subsystem. The window assembly includes an inner window, and outer window, and a support subsystem between the inner and the outer windows defining a plurality of infrared transparent gas flow cooling channels between the inner and outer windows. A source of gas is coupled to the cooling channels for cooling the outer window.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
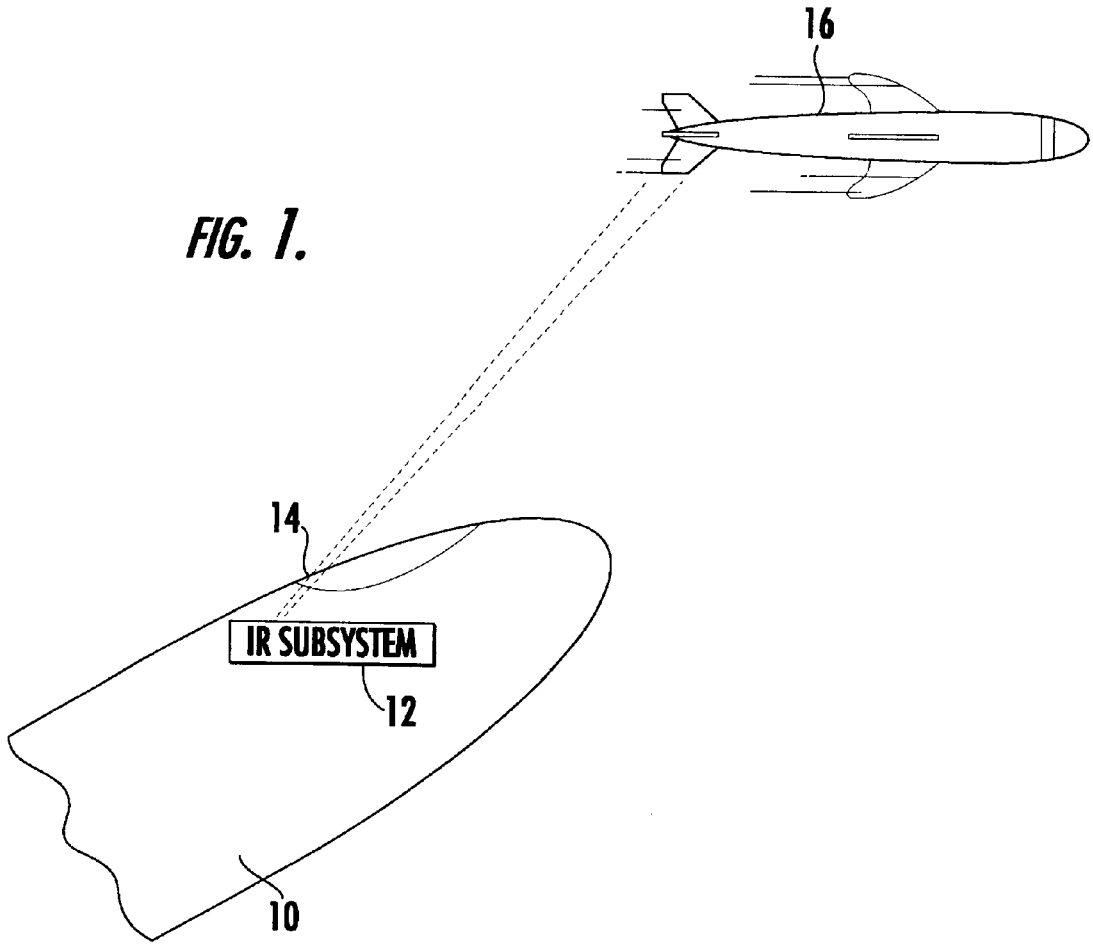
FIG. 1 is a schematic view of an interceptor missile which includes a protective window assembly in accordance with the subject invention.

Interceptor missile 10, FIG. 1 includes infrared radiation detection subsystem 12 in optical communication with protective window assembly 14 as discussed in the Background of the Invention section above to detect infrared radiation emitted by target 16 and to adjust the trajectory of missile 10 accordingly to thus strike target 16.

Figure 2:
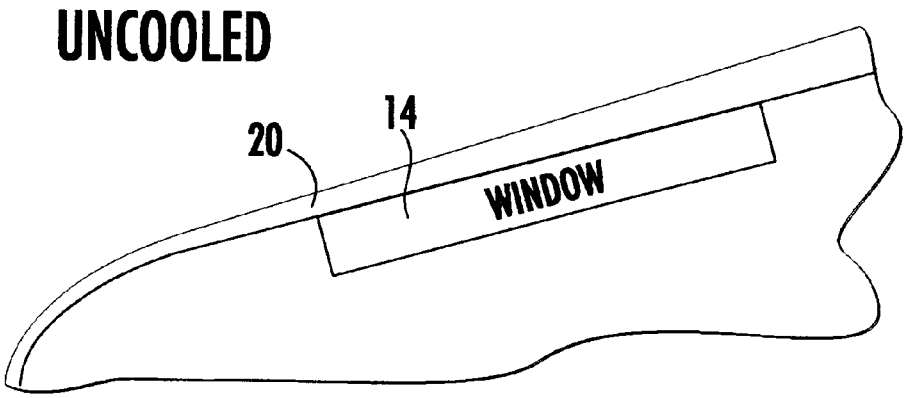
FIG. 2. (PRIOR ART)
FIG. 2 is a schematic view of a prior art window assembly subjected to the effects of a boundary layer which causes frictional heating.

In FIG. 2, window assembly 14 is not cooled and the effects of boundary layer 20 cause frictional heating and destructive thermal shocks, optical distortions, and/or causes window assembly 14 itself to emit infrared radiation. Window assembly 14 is heated by friction with the air stream as shown at 20 which leads to degraded seeker performance due to rapid heating of the window when it is first exposed to the flight environment which then produces a mechanical shock wave in the window which can result in mechanical failure, high window temperatures driven by the aerodynamic heating which cause the window to emit strongly in the infrared spectrum and which, as a result, significantly degrades the seeker signal to noise ratio and in extreme cases effectively blinds the seeker. Moreover, since the index of refraction of the window material is temperature independent, any in-plane non-uniform temperature distribution leads to varying optical path lengths through the window which degrades imaging performance.

Figure 3:
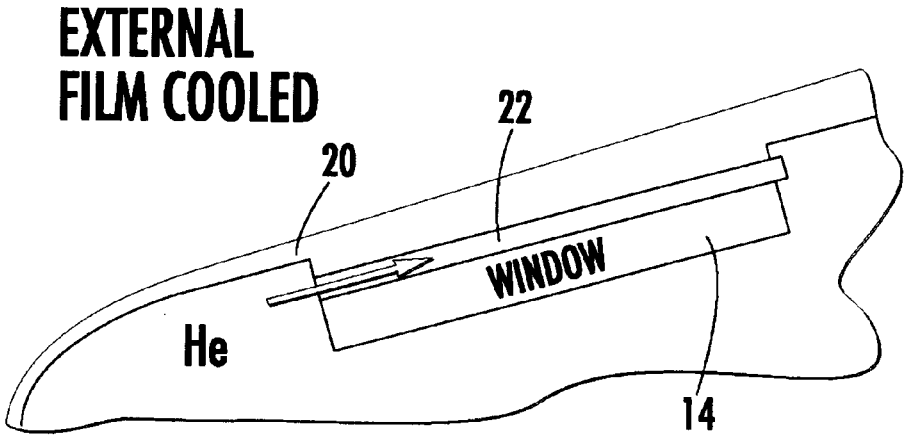
FIG. 3. (PRIOR ART)
FIG. 3 is a schematic view of a prior art externally cooled window assembly.

In FIG. 3, window assembly 14 is cooled externally by a film 22 of helium gas between the outer surface of window assembly 14 and external air stream 20. As delineated in the Background, this prior art design suffers from the disadvantages that a large quantity of cooling gas must be stored onboard the interceptor missile, special design considerations must be employed to ensure a uniform boundary layer, and the associated valves, feedback mechanisms, and the resulting complexity of such a system results in a costly design prone to failure. In addition, the cooling effectiveness of the stream of gas across the outer surface of the window can be adversely impacted by changes in missile attitude and interactions between the divert thrusters of the interceptor missile and the air stream flowing over the window. Other design shortcomings of the external film cooling design proposal depicted in FIG. 3 are discussed more thoroughly in the Background section above.

Figure 4:
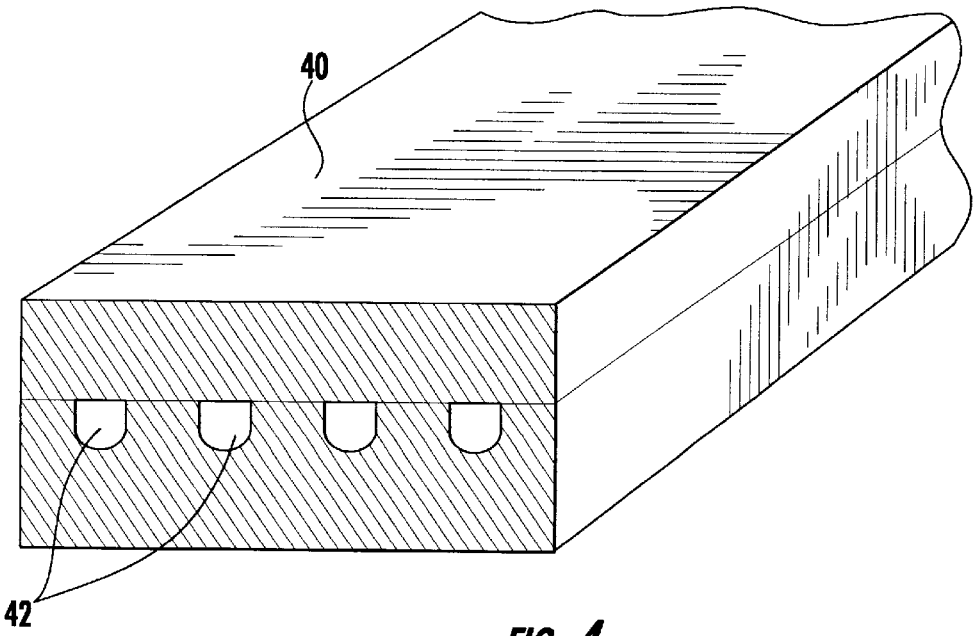
FIG. 4. (PRIOR ART)
FIG. 4 is a schematic cross-sectional view of a prior art internal liquid cooled window assembly.

In prior art internally liquid cooled window assembly 40, FIG. 4, a liquid coolant is carried by internal channels 42. In this design, since the liquid coolant is opaque to infrared radiation, cooling channels 42 must be made relatively narrow and widely spaced in order for window assembly 40 to transmit sufficient infrared radiation. Unfortunately, significant temperature gradients are created between the long cooling channels 42 which produce a laterally non-uniform index of refraction which degrades the resultant image. Also, defraction of the signals from targets or the sun by cooling channels 42 can create false targets in the field of view of window assembly 40.

Figure 5:
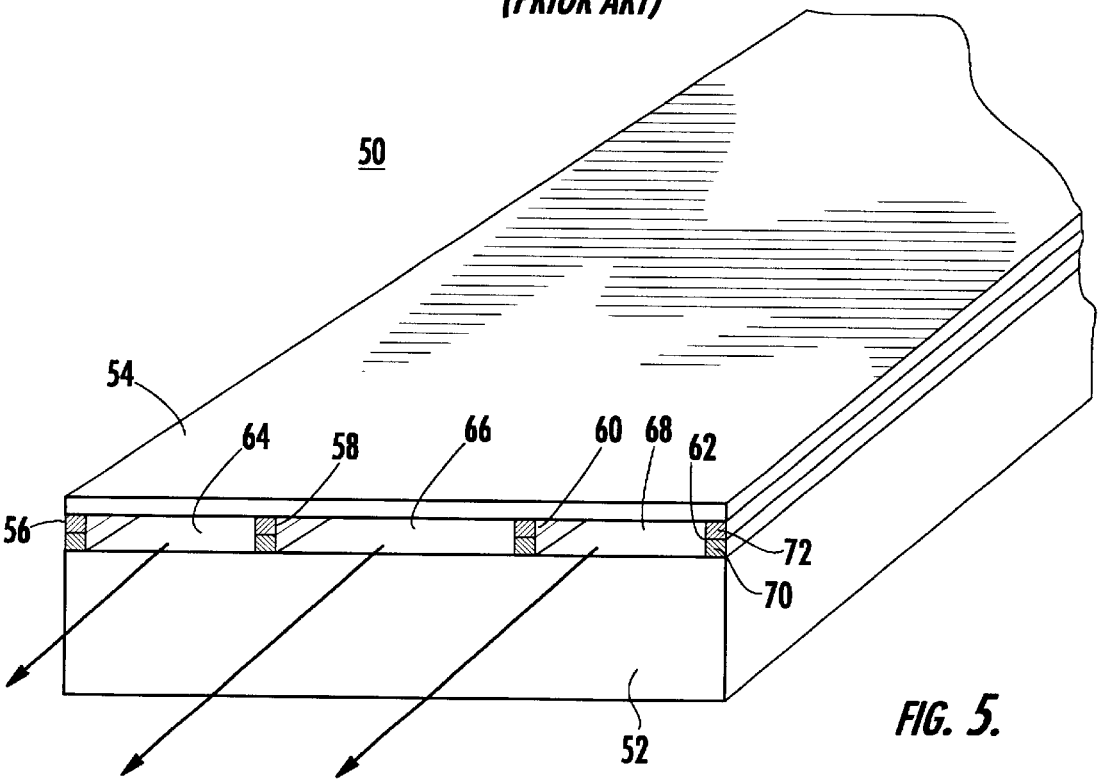
FIG. 5 is a schematic view of the internal fluid cooled window assembly of the subject invention.

In the subject invention, these limitations and deficiencies associated with external film cooling and internal liquid cooling designs are overcome by internal fluid cooled window assembly 50, FIG. 5.

Window assembly 50 includes thick supportive inner window 52, thin outer window 54, and a support subsystem between inner window 52 and outer window 54 defining at least one but usually a few transparent fluid flow channels between inner window 52 and outer window 54 for cooling outer window 54 without adversely effecting the optical properties of either inner window 52 or outer window 54.

In the preferred embodiment, the support subsystem includes a plurality, e.g., four longitudinally running spacer elements 56, 58, 60, and 62 between inner window 52 and outer window 54 wherein each pair of adjacent spacer elements define cooling channels 64, 66, and 68 therebetween as shown.

In one design, the length of window assembly 50 was 8 cm, the width was 3–4 cm, the thickness of inner window 52 was 3 mm, the thickness of outer window 54 was 1 mm, the height of the spacer elements was 2 mm, and their width was 1 mm. The cross-sectional area of cooling channels 64, 66, and 68 is preferably designed to be sufficiently large to prevent sonic flow velocities of the fluid flowing therein. In the preferred design, the thickness of inner window 52 is substantially greater (e.g., 2–3 times) the thickness of outer window 54. A thinner outer window is easier to uniformly cool and results in lower infrared radiation emissions while the thicker inner window not subject to the heating effects of the boundary layer provides the structure required to survive the mechanical shock imparted by blowing off the protective cover (not shown) on the window assembly. In combination, thin outer window 54, spacer elements 56, 58, 60, and 62, and thick inner window 52 has a strength sufficient to meet the mechanical loading and thermal and mechanical shock requirements for advanced interceptor missiles, and at the same time, requires less cooling gas volume and simpler gas flows than external film cooling designs and without the formation of temperature gradients between and along the cooling channels which produce a laterally non-uniform index of refraction which degrades the image as is the case with internal liquid cooling designs which, in addition, included cooling channels which defracted signals from targets or the sun creating false targets in the field of view of the window assembly.

Also in the preferred design, spacer elements 56, 58, 60, and 62 are made of two different materials, for example, a base 70 of flexible RTV rubber or a plastic (e.g. Duroid) and a steel heat resistant interface portion 72 as shown for spacer element 62.

Typically, the materials of spacer elements 56, 58, 60, and 62 are chosen such that they have a thermal conductivity which matches the conductive heat transfer rate of the fluid flowing in the channel which is preferably a gas transparent to infrared radiation such as nitrogen, helium, argon, or sulfur hexaflouride. If there are any liquid coolants transparent to infrared radiation, they may be utilized as well.

Inner window 52 and outer window 54 may be made of aluminum oxynitride, yttria, aluminum oxide, zinc sulfide, silicon, gallium phosphide, silicon carbide, and diamond although at the present time it is difficult to fabricate diamond into the shape of relatively thin outer window 54.

One key advantage of the design shown in FIG. 5 over prior art internally liquid cooled window assemblies is that the combined cross sectional area of channels 64, 66, and 68, each approximately 1–1.3 cm wide, is substantially greater than the area taken up by support elements 56, 58, 60, and 62 each approximately only 1 mm wide. In this way, adequate cooling is effected without reducing the active area of window assembly 50 and without lateral temperature gradients and the resulting spatially independent phase errors associated with liquid cooling channels formed in the window.

One key to recognizing the benefits of the present design approach is an understanding that for internally cooled windows, the performance limiting factor is often the uniformity of the temperature of the window; not its absolute temperature. In accordance with the subject invention, the use of an infrared transmissive gas coolant permits the viewing portion of the window to be in intimate contact with the cooling medium thus minimizing lateral temperature gradients and the resulting spatially independent phase errors. Cooling channels 64, 66, and 68 can be made relatively wide with narrow spacer elements 56, 58, 60, and 62 providing sufficient mechanical rigidity and yet minimizing defraction effects.

Figure 6:
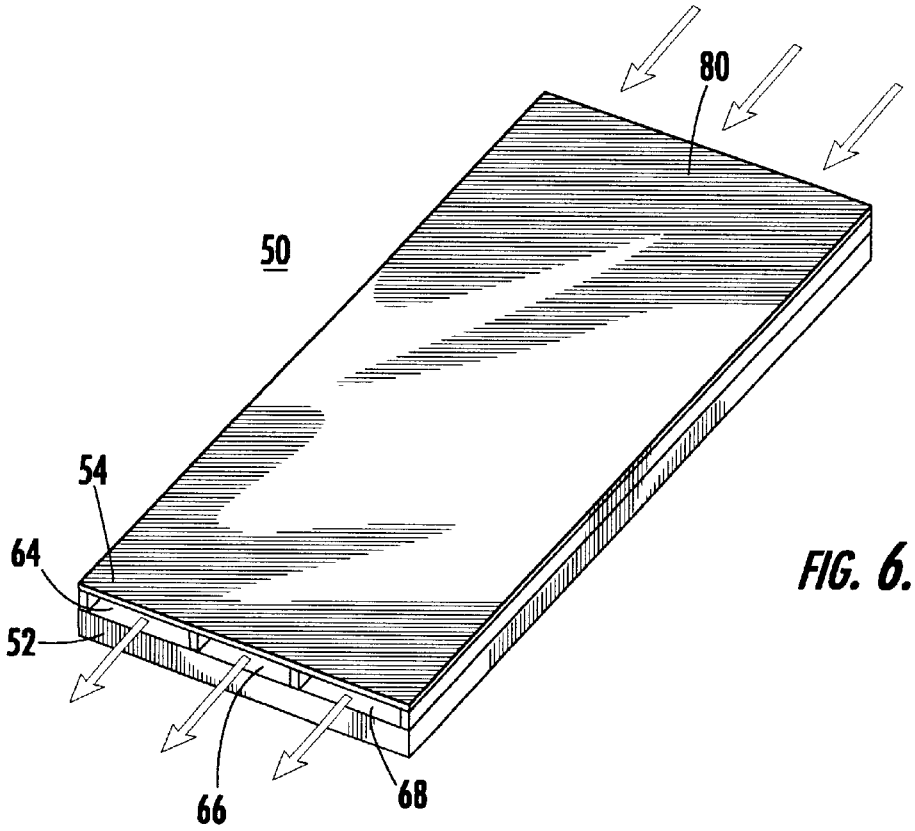
FIG. 6 is a depiction of the results of a computer simulation showing the temperature profile of the window assembly of the subject invention subjected to a uniform external heat load.

Computer modeling based on the design shown in FIG. 5 reveals that with the appropriate choices of spacer element material, the gas species, and the gas flow rate, temperature gradients in the outer window both parallel and transverse to the coolant flow can be made very small to minimize image degradation due to the temperature independent index of defraction. Since the spacer elements and the cooling channels thermally insulate inner window 52, only the surface of the thin outer window 54 emits strongly so that the total emitted flux can be made low. FIG. 6 is the output of the results of a computer model wherein window assembly 50 was mounted on an interceptor missile forebody at a 23° inclination at 20 km altitude, and at a speed of 2 km/sec after 4 seconds of flight. The coolant flowing through channels 64, 66, and 68 was nitrogen at a flow rate of 0.067 kg/sec. The window was 8 cm by 3.25 cm in area. Thin outer window 54 was cooled in a uniform manner and reached a maximum temperature of about 825° K. at the thinnest portion of the extended air stream boundary layer as shown at 80 and a maximum temperature of about 843° K. elsewhere with the spacer elements having little thermal effect on thin outer window 54 which is highly desirable and a significant improvement over the prior art.

Figure 7:
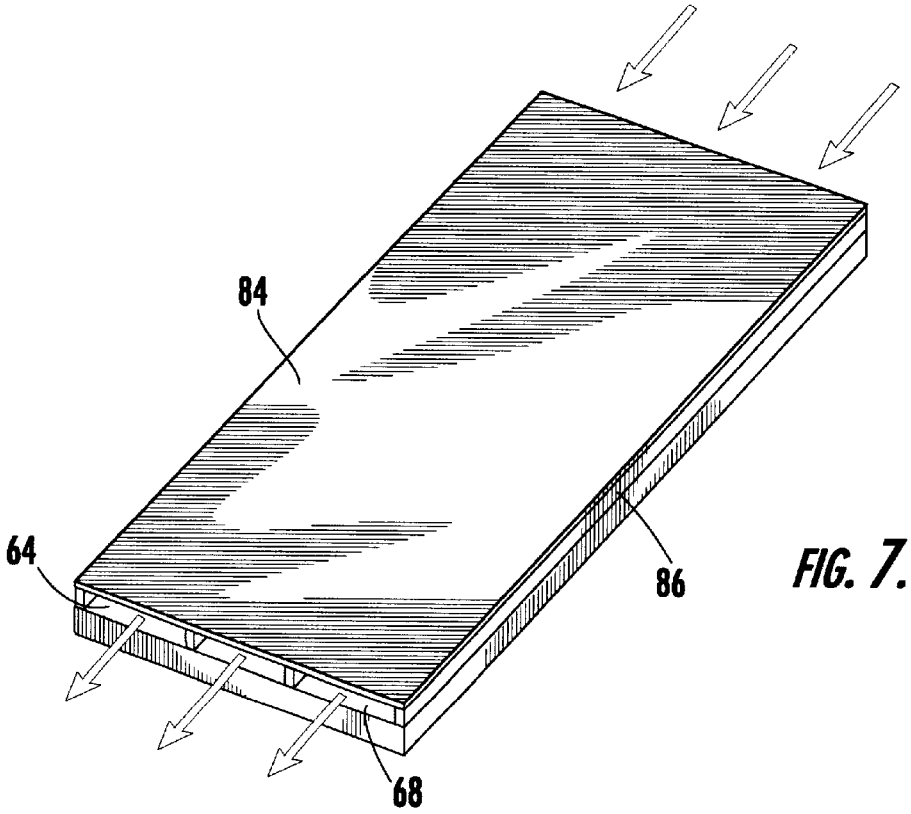
FIG. 7 is similar to FIG. 6 except the window assembly was subject to a non-uniform external heat load.

In FIG. 7, the same window assembly was subjected to a non-uniform external heat load and the result was that areas 84 and 86 reached a higher temperature than the other portions of the window in which case the flow rate in channels 64 and 68 could be adjusted to compensate.

Figure 8:
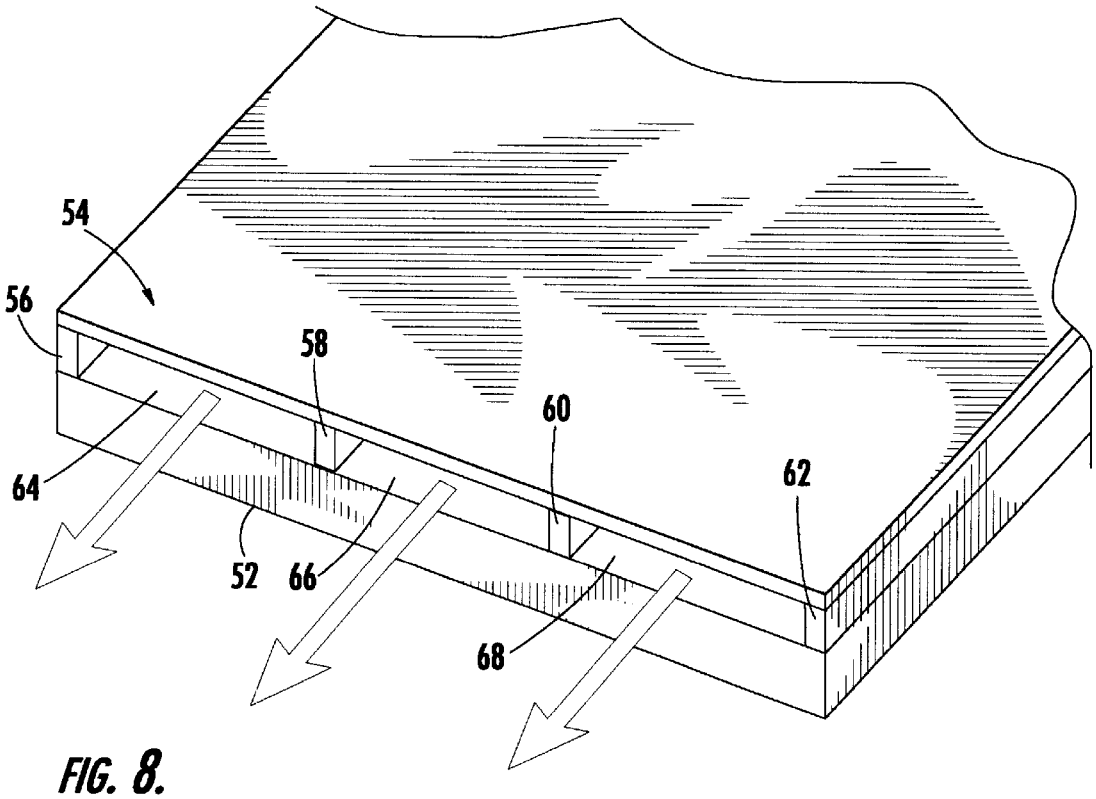
FIG. 8 is an enlarged view of a portion of FIG. 7.

In FIG. 8, the effects of spacer elements 56, 58, 60, and 62 are shown when outer window 54 is subjected to a non-uniform external heat load showing that with the appropriate choices of spacer material, the gas species, and the flow rate, the temperature gradients in outer window 54 both parallel and transverse to the direction of the coolant flow can be made very small to minimize image degradation due to the temperature dependent index of refraction. The materials chosen for spacer elements 56, 58, 60, and 62 should not be too insulative in order to prevent gradients in the temperature of outer window 54 nor too conductive which would result in the same effect. Instead, the conductivity of the spacer element should be tailored material to provide, as much as possible, a constant temperature across outer window 54. Also, the spacer elements should be somewhat flexible thus allowing thin outer window 54 to flex and survive mechanical shocks.

Figure 9:
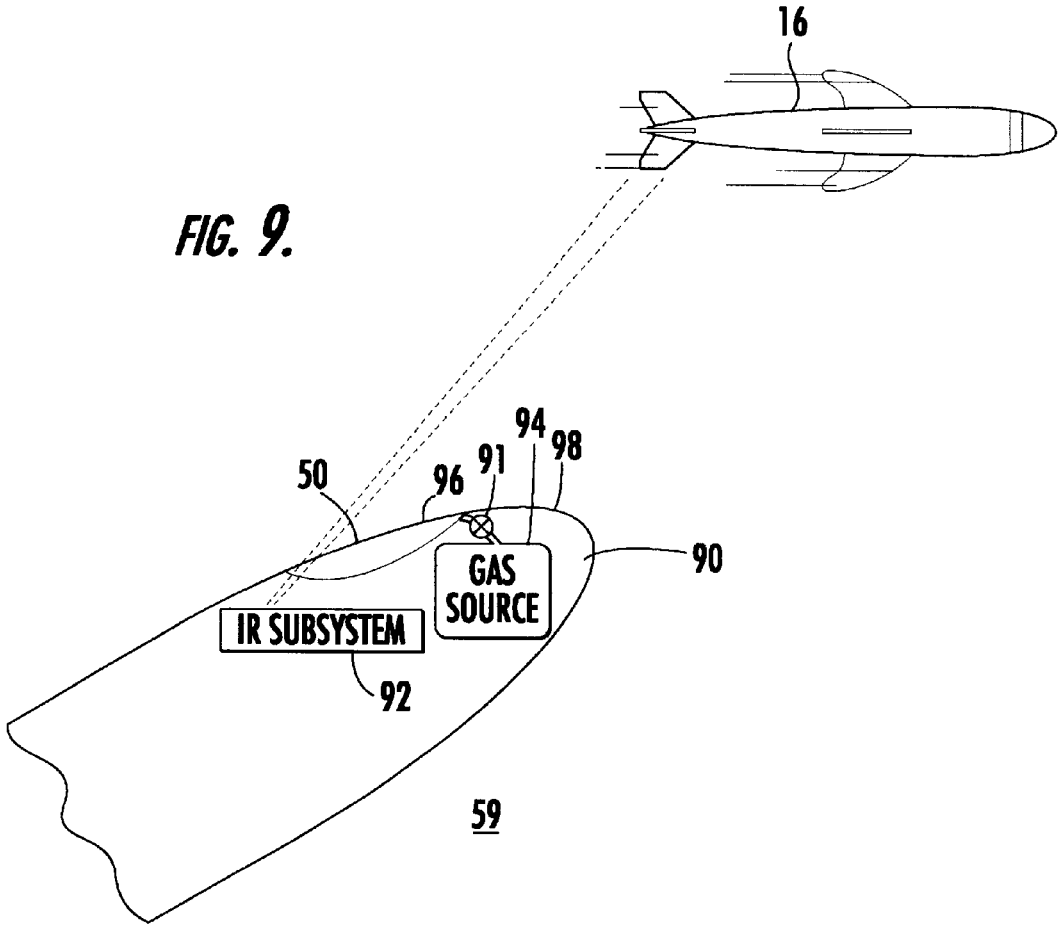
FIG. 9 is a schematic view of an interceptor missile incorporating the window assembly of the subject invention.

In a complete assembly, as shown in FIG. 9, interceptor missile 90 includes infrared radiation detection subsystem 92, window assembly 50 (see FIG. 5) in the body of missile 90 optically coupled to infrared radiation detection subsystem 92 and a source of gas 94 transparent to infrared radiation coupled to the individual cooling channels between the inner and outer windows of window assembly 50. The flow of gas to the window is controlled by regulator 91. Window assembly 50 is effectively and uniformly cooled without using as much gas as in designs where the window is cooled externally and without disrupting the optical characteristics of the window as is the case with internal liquid cooled designs. For proposed external cooling designs, the estimated size of the helium supply source was approximately 420 $in^3$. In the subject design, gas source 94 need only be about half that size. Since the choice of the coolant affects the optical performance of window assembly 50 and since the prior art externally cooled film design was limited to helium, window assembly 50, FIG. 9 offers more design choices, more degrees of engineering and design freedom, the ability to incorporate a smaller supply of cooling gas, and less complex controls. In addition, the boundary layer causes the greatest heating at the front portion 96 of window assembly 50 which is offset by the fact that this is also where the cooling gas is at the lowest temperature resulting in more uniform cooling of window assembly 50. In the design shown in FIG. 9, the exhaust gas could even be used to cool nose 98 or other areas of interceptor missile 90.

Window assembly 50, FIG. 5 may have uses other than in conjunction with interceptor missiles, however, such as windows for high temperature vessels wherein the temperature inside the vessel is measured using infrared radiation detectors. In other embodiments, a fluid including water may be used as the cooling medium. In still other embodiments, a more complex support subsystem may be used which includes mechanical spacers, springs, and the like. For use in conjunction with interceptor missile 90, the materials of the spacer elements should be selected such that they properly. support the load on window assembly 50, minimize the temperature gradients on the outer window, and allow the thin outer window to expand.

Therefore, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. An internal fluid cooled window assembly comprising:

an inner window;

an outer window; and a support subsystem between the inner window and the outer window defining at least one transparent fluid flow channel between the inner and outer window for cooling the outer window, the support subsystem including a plurality of spacer elements between the inner and outer windows, each pair of adjacent spacer elements defining a cooling channel therebetween, the spacer elements having a thermal conductivity approximating the convective heat transfer rate of the fluid flowing in the channels.

2. The window assembly of claim 1 in which the inner window has a thickness substantially greater than the thickness of the outer window.

3. The window assembly of claim 2 in which each spacer element is made of two different materials.

4. The window assembly of claim 1 in which the fluid is a gas.

5. The window assembly of claim 4 in which the gas is selected from the group consisting of nitrogen, helium, argon, and sulfur hexaflouride.

6. The window assembly of claim 1 in which the fluid is a liquid.

7. The window assembly of claim 6 in which the liquid includes water.

8. The window assembly of claim 1 in which the inner and outer windows are made of a material selected from the group consisting of aluminum oxidynitride, yttria, aluminum oxide, zinc sulfide, silicon, gallium phosphide, and diamond.

9. The window assembly of claim 1 in which each cooling channel between the inner and outer windows has a cross sectional area sufficient to prevent sonic flow velocities of the fluid flowing therein.

10. The window assembly of claim 1 in which the support subsystem defines a plurality of flow channels, the combined area of which is substantially greater than area occupied by the support subsystem.

11. The window assembly of claim 1 in which the fluid is transparent to infrared radiation.

12. An interceptor missile comprising:

an infrared radiation detection subsystem;

a window assembly in the hull of the missile optically coupled to the infrared radiation detection subsystem, the window assembly including:

an inner window, an outer window, and a support subsystem between the inner and the outer windows defining a plurality of infrared transparent gas flow cooling channels between the inner and outer windows for cooling the outer window, and a source of gas coupled to the cooling channels for cooling the outer window.

13. The window assembly of claim 12 in which the inner window has a thickness substantially greater, than the thickness of the outer window.

14. The window assembly of claim 12 in which the support subsystem includes a plurality of longitudinally running spacer elements between the inner and outer windows, each pair of adjacent spacer elements defining a cooling channel therebetween.

15. The window assembly of claim 14 in which each spacer element is made of two different materials.

16. The window assembly of claim 15 in which the materials of the spacer elements have in combination a thermal conductivity which matches the connective heat transfer rate of the fluid flowing in the channels.

17. The window assembly of claim 12 in which the gas is selected from the group consisting of nitrogen, helium, argon, and sulfur hexaflouride.

18. The window assembly of claim 12 in which the inner and outer windows are made of a material selected from the group consisting of aluminum oxidynitride, yttria, aluminum oxide, zinc sulfide, silicon, gallium phosphide, and diamond.

19. The window assembly of claim 12 in which each cooling channel between the inner and outer windows has a cross sectional area sufficient to prevent sonic flow velocities of the fluid flowing therein.

20. The window assembly of claim 12 in which the support subsystem defines a plurality of flow channels, the combined area of which is substantially greater than area occupied by the support subsystem.

21. An internal fluid cooled window assembly comprising:

an inner window;

an outer window; and a support subsystem between the inner window and the outer window defining a plurality of infrared radiation transparent fluid flow channels between the inner and outer windows, the combined area of the flow channels being substantially greater than the area occupied by the support subsystem for cooling the outer window, the support subsystem including a plurality of spacer elements between the inner and outer windows, each pair of adjacent spacer elements defining a cooling channel therebetween, the spacer elements having a thermal conductivity approximating the convective heat transfer rate of the fluid flowing in the channels.

22. An interceptor missile comprising:

an infrared radiation detection subsystem;

a window assembly in the hull of the missile optically coupled to the infrared radiation detection subsystem, the window assembly including:

an inner window, an outer window, and a support subsystem between the inner and the outer windows defining a plurality of infrared transparent gas flow cooling channels between the inner and outer windows for cooling the outer window, a source of gas coupled to the cooling channels for cooling the outer window, the support subsystem including a plurality of spacer elements between the inner and outer windows, each pair of adjacent spacer elements defining a cooling channel there between, the spacer elements having a thermal conductivity approximating the convective heat transfer rate of the fluid flowing in the channels.

* * * * *